United States Patent [19]

Matsuuchi et al.

[11] Patent Number: 4,994,852

[45] Date of Patent: Feb. 19, 1991

[54] IMAGE FORMING APPARATUS HAVING A MALFUNCTION DETECTION DEVICE AND POWER SHUTDOWN THEREFOR

[75] Inventors: Yasuyuki Matsuuchi; Kenzo Nagata, both of Osaka, Japan

[73] Assignee: Minolta Camera Kabushiki Kaisha, Osaka, Japan

[21] Appl. No.: 232,763

[22] Filed: Aug. 16, 1988

[30] Foreign Application Priority Data

Aug. 18, 1987 [JP] Japan ..... 62-204810
Aug. 18, 1987 [JP] Japan ..... 62-204811

[51] Int. Cl.[5] ..... G03G 21/00; G03G 15/20

[52] U.S. Cl. ..... 355/206; 219/216; 219/497; 355/282

[58] Field of Search ..... 355/205, 206, 282; 219/216, 492, 497, 506; 361/106

[56] References Cited

U.S. PATENT DOCUMENTS

| | | | |
|---|---|---|---|
| 4,144,835 | 3/1979 | Fukase et al. | 118/5 |
| 4,439,143 | 3/1984 | Hanamoto et al. | 432/36 |
| 4,585,325 | 4/1986 | Euler | 219/216 X |
| 4,675,777 | 6/1987 | Watrous | 361/106 |
| 4,745,430 | 5/1988 | Tsuchiya | 219/216 X |

FOREIGN PATENT DOCUMENTS

| | | |
|---|---|---|
| 56-161558 | 12/1981 | Japan . |
| 60-115977 | 6/1985 | Japan . |

*Primary Examiner*—Fred L. Braun
*Attorney, Agent, or Firm*—Burns, Doane, Swecker & Mathis

[57] ABSTRACT

An image forming apparatus for electrophotographically producing a toner image on a recording sheet medium, a toner image fixing assembly which includes a heater unit having an operative condition to thermally fix the toner image on the recording sheet medium, a power supply circuit for electrically energizing the heater unit through a switch, a microprocessor unit for controlling the power supply circuit, the microprocessor unit being operative to supply to the power supply circuit a control signal effective to actuate the switch to cyclically close and open for a predetermined period of time for the purpose of inspecting the heater unit for any malfunction, a detecting element directly responsive to the condition of the heater unit and operative to produce a signal indicative of the detected condition of the heater unit, a malfunction detector network responsive to the signal from the detecting element, the malfunction detector network being operative to produce a malfunction signal indicating a malfunction of the heater unit when, in the presence of the control signal from the digital control network, the signal from the detecting element indicates that the heater unit is continuously in operation, and a disabling device for forcibly disabling the power supply circuit in response to the malfunction signal from the malfunction detector network.

8 Claims, 5 Drawing Sheets

IMAGE FORMING APPARATUS HAVING A MALFUNCTION DETECTION DEVICE AND POWER SHUTDOWN THEREFOR

FIELD OF THE INVENTION

The present invention relates to an image forming apparatus such as typically an electrophotographic image duplicating or printing apparatus and, more particularly, to an image fixing assembly of such an image forming apparatus. More particularly, the present invention is concerned with a control system for the image fixing assembly of an image forming apparatus such as an electrophotographic image duplicating or printing apparatus.

BACKGROUND OF THE INVENTION

An image fixing assembly of an electrophotographic image duplicating or printing apparatus ordinarily uses a combination of a heater roller and a pressing roller held in rollable contact with the heater roller. The image fixing assembly thus composed of the heater and pressing rollers is disposed anterior, in the direction of travel of a print sheet, to an image transfer drum by means of which toner images each formed by toner particles are produced on one surface of the print sheet. The print sheet having the toner images thus formed on one surface thereof is transported past the image transfer drum to the image fixing assembly and is passed between the heater and pressing rollers.

The heater roller which forms part of the image fixing assembly has incorporated therein a heater unit which is activated or de-activated at controlled timings during each cycle of printing operation so that the heater roller is to be heated to a predetermined optimum temperature or to a temperature within a predetermined temperature range. The timings at which the heater unit is to be activated and de-activated are controlled on the basis of a signal produced from a temperature sensitive element typically implemented by a thermister. The thermister is located in proximity to the heater roller to detect the temperature of the outer peripheral surface of the roller for producing a signal which varies with the detected temperature of the heater roller.

The signal output from the thermister is supplied to a combination of a resistor bridge network including the thermister as one of the resistors and a comparator responsive to a voltage output from the bridge network. Alternatively, the signal from the thermister is supplied to a microprocessor unit and is processed on the basis of the various data which are preliminarily stored therein. An image forming apparatus using a control system for the image fixing assembly of the apparatus is disclosed in, for example, U.S. Pat. No. 4,144,835 and Japanese Provisional Patent Publication (Kokai) No. 60-115977.

In a known heater control system of the described nature, the thermister implementing the temperature sensitive element may fail to operate properly or the microprocessor unit responsive to the signal output from the temperature sensitive element may malfunction in processing the signal received. Such a malfunction of the microprocessor unit may be invited due to an ingress of a noise of a lightning surge into the microprocessor unit chip. In the event the temperature sensitive element has thus failed or the microprocessor unit is disabled from operating properly, the heater unit of the image fixing assembly may be heated excessively and may thus cause damage to the heater roller and associated members and elements or cause firing of the print sheet being passed through the fixing assembly.

An overheat of the heater roller can be to some extent prevented through provision of a fuse or other type of temperature responsive circuit breaker inserted into the power supply circuit for the heater unit. A temperature responsive circuit breaker presently available is however not fully acceptable for its response characteristics. The temperature at which the fuse is to be blown is ordinarily selected to be higher than the maximum temperature to which the heater roller may be possibly heated during normal operation of the image fixing assembly. If the heater unit is de-energized by the blow-out of the fuse, it may thus happen that, at the point of time the fuse is blown out, damage has already been caused to the heater roller although the firing from the heater unit could have been successfully precluded.

Attempts have therefore been made to provide means adapted to de-activate the heater unit before the fuse or other type of temperature sensitive circuit breaker is blown in response to an unusual rise in the temperature of the heater roller. A heater control system which has thus far been proposed however has a problem in that the system is dependent solely on a signal produced by a temperature sensitive element such as a thermister. Another problem is that the system is designed on the assumption that the temperature sensitive element at all times operates in a sound state or the microprocessor unit responsive to the signal from the temperature sensitive element at all times functions properly in respect of the hardware structure and software programs.

When the temperature sensitive element of the heater control system fails to properly operate or the microprocessor unit included in the control system malfunctions, the heater control system could not correctly cope with the situations involved. It may also be noted that the temperature sensitive element is disposed to be responsive to the temperature of the heater roller at the outer peripheral surface of the roller so that, where the heater unit includes two or more heater elements, the control system could not locate the trouble from the signal produced by the temperature sensitive element.

It is, accordingly, an object of the present invention to provide an image forming apparatus in which the control system for the image fixing assembly of the apparatus operates such that whether or not the heater unit is unusually activated is determined not from the signal from the temperature sensitive element but on the basis of a signal output from, for example, an ultrared ray sensor responsive to emission of radiation from a heater element. This means that the state of the heater unit is inspected without respect to the temperature to which the heater roller is heated after the apparatus is switched in. When any failure is present in the control system so that the heater unit is unusually activated after the apparatus is switched in, the heater unit is automatically de-activated upon detection of such unusual activation of the heater unit. The heater unit could not therefore be activated unless the failure in the control system is remedied and, if the power supply switch for the apparatus is turned on repeatedly with the failure unremedied, any accident which might otherwise result from improper activation of the heater unit such as the damage of the heater roller or the firing from the roller might be caused due to an overheat of the heater roller in a prior-art image forming apparatus can be reliably precluded.

The ultrared ray sensor used as in the apparatus of this nature is one of the various detector means which further include a galvanometer responsive to the flow of current through the lines connected to the heater element or elements, a magnetic field sensor responsive to variation in the magnetic field induced by the current through such lines, and any radiation responsive detector responsive to the visible or hot-wave radiation from the heater element or elements. The radiation responsive detector may be implemented a thermister, a positive temperature coefficient thermister, or a pyroelectric-effect sensor.

SUMMARY OF THE INVENTION

In accordance with the present invention, there is provided an image forming apparatus including a radiation emitting element having an operative condition emitting radiation and an inoperative condition not emitting radiation, comprising (a) a power supply circuit for electrically energizing the radiation emitting element through switch means, (b) a digital control network for producing a control signal effective to actuate the switch means to cyclically close and open for the purpose of inspecting the radiation emitting element for any malfunction, (c) a detecting element directly responsive to the operative and inoperative conditions of the radiation emitting element, the detecting element being operative to produce a signal indicating the detected condition of the radiation emitting element, (d) malfunction detecting means for producing a malfunction signal indicating a malfunction of the radiation emitting element on the basis of the signal from the detecting element in the presence of the control signal from the digital control network, the malfunction detecting means being operative to produce the malfunction signal when the signal from the detecting element indicates that the radiation emitting element is in a condition continuously emitting radiation, and (e) means for forcibly disabling the power supply circuit in response to the malfunction signal from the malfunction detecting means.

In accordance with another outstanding aspect of the present invention, there is provided an electrophotographic image duplicating apparatus comprising (a) means for electrophotographically producing a toner image on a recording sheet medium, (b) a toner image fixing assembly comprising a heater unit having an operative condition to thermally fix the toner image on the recording sheet medium, (c) a power supply circuit for electrically energizing the heater unit through switch means, (d) a microprocessor unit for controlling the power supply circuit, the microprocessor unit being operative to supply to the power supply circuit a control signal effective to actuate the switch means to cyclically close and open for a predetermined period of time for the purpose of inspecting the heater unit for any malfunction, (e) a detecting element directly responsive to the condition of the heater unit and operative to produce a signal indicative of the detected condition of the heater unit, (f) a malfunction detector network responsive to the signal from the detecting element, the malfunction detector network being operative to produce a malfunction signal indicating a malfunction of the heater unit when, in the presence of the control signal from the microprocessor unit, the signal from the detecting element indicates that the heater unit is continuously in operation, and (g) disabling means for forcibly disabling the power supply circuit in response to the malfunction signal from the malfunction detector network.

BRIEF DESCRIPTION OF THE DRAWINGS

The features and advantages of an image forming apparatus according to the present invention will be more clearly appreciated from the following description taken in conjunction with the accompanying drawings in which.

DESCRIPTION OF THE PREFERRED EMBODIMENTS

In the description to follow, an image forming apparatus according to the present invention is assumed to be embodied by an electrophotographic image duplicating apparatus which per se is well known in the art.

Figure 1:
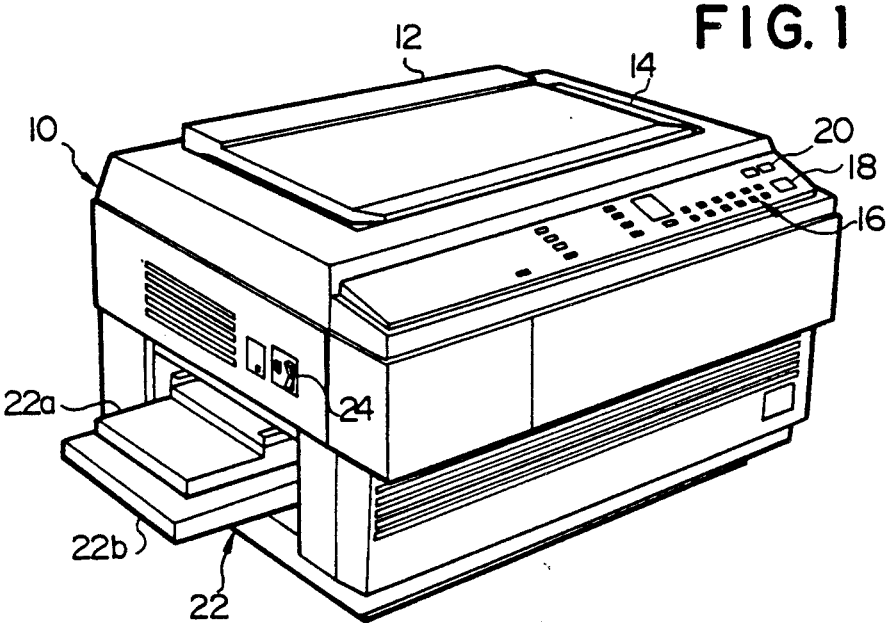
FIG. 1 is a perspective view showing a typical example of an image forming apparatus to which the present invention may be applied by preference.
Figure 2:
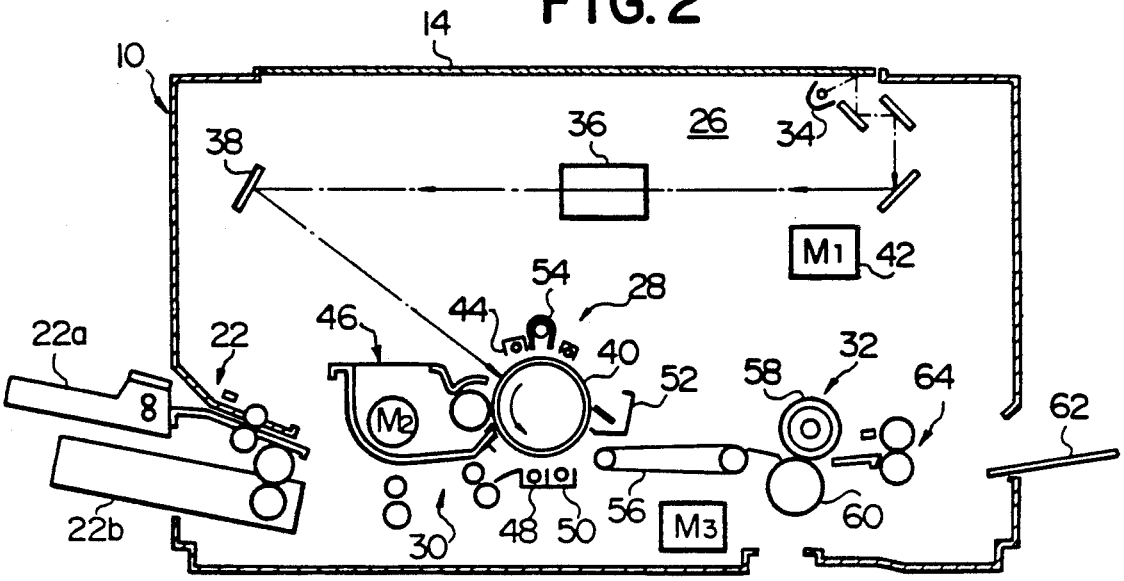
FIG. 2 is a schematic side elevation view showing the general optical and mechanical arrangements of the image forming apparatus illustrated in FIG. 1.

Referring to FIG. 1, such an image duplicating apparatus embodying the present invention comprises a housing structure 10 having an upper panel portion carrying a document retaining plate 12 which is shown resting on a transparent document support table 14 which forms part of the housing structure 10 as will be better seen from FIG. 2. A sheet of document bearing images to be reproduced is to be placed on this document support table 14.

On the housing structure 10 is further provided a control panel 16 on which are arranged a variety of switches, keys, indicators and display windows including a print start key 18 and a display window 20. The print start key 18 is used to instruct the apparatus to start a cycle of printing operation for producing a single printed output or a selected number of printed outputs. The selected number of printed outputs is numerically indicated on the display section and is successively decremented as a printed output is produced from the apparatus. In the event any failure takes place within the apparatus, there is indicated on this display window 20 a code designating the nature or location of the failure to enable the operator or the serviceman to locate the trouble.

The apparatus embodying the present invention further comprises a print sheet supply arrangement 22 which is shown 22*b* each storing a stock of print sheets detachably assembled to the apparatus. At a suitable location on the housing structure 10 is provided a power supply switch 24 to be used to switch in the apparatus as a whole so that, when the power supply switch 24 is manually depressed, main ac power is supplied to the apparatus.

Within the housing structure 10 of the apparatus embodying the present invention are provided an optical document scanning system 26, an image reproducing system 28, a print sheet feed mechanism 30 and an image fixing assembly 32. The optical scanning system 26 comprises a document exposure lamp 34 from which a beam of light is incident on and reflected from the lower face of the document sheet on the document support table 14. The reflected light is downwardly directed and is thereafter re-directed to advance through an image magnification/reduction lens unit 36 toward a projecting mirror 38 by reflector mirrors appropriately arranged in conjunction with the document exposure lamp 34. Past the projecting mirror 38, the light travels toward a cylindrical image transfer drum 40 which forms part of the image reproducing system 28.

The image transfer drum 40 of the image reproducing system 28 has a peripheral surface layer coated with a photoconductive substance and is to be driven for rotation in a direction of arrow by appropriate drive means, which is assumed to include a main drive motor 42 ($M_1$). The main drive motor 42 is used to drive not only the image transfer drum 40 but also the movable elements of the optical scanning system 26 and is, thus, operative when the apparatus is in operation.

The image reproducing system 28 of the apparatus embodying the present invention further comprises a main charger 44 to sensitize the photoconductive peripheral surface of the image transfer drum 40 by applying electrostatic charges uniformly to the surface of the drum 40. These charges are dissipated in areas exposed to light and electrostatic latent images are created by the charges remaining on the drum 40 upon irradiation with light from the projecting mirror 38. Posterior to the path of light to the drum 40 is located an image developing unit 46 having a stock of toner particles to be applied to the photoconductive peripheral surface of the image transfer drum 40. Visible toner images are thus produced conformingly to the latent images on the drum 40. The image developing unit 46 has a developer motor ($M_2$) incorporated therein.

Posterior to the image developing unit 46 in turn is provided an image transfer charger 48 which is operative to charge the print sheet so that the toner images on the image transfer drum 40 are transferred thereto. The print sheet thus having the toner images carried thereon is cleared of charges by a separation charger 50 located posterior to the image transfer charger 48. There is further provided a drum cleaner unit 52 which removes any residual toner particles from the peripheral surface of the drum 40. Posterior to this cleaner unit 52 in turn is positioned a charge eraser lamp 54 which irradiates the cleaned peripheral surface of the drum 40 to eliminate the charges which may be left thereon.

A print sheet is picked up from the upper or lower print sheet supply cassettes 22*a* and 22*b* of the print sheet supply arrangement 22 and is guided to travel toward the image transfer drum 40 by means of the paper feed mechanism 30. The paper feed mechanism 30 comprises a print sheet transport belt assembly 56 positioned posterior to the area where the print sheet is separated from the image transfer drum 40. The print sheet separated from the image transfer drum 40 is thus conveyed by means of the transport belt assembly 56 to the image fixing assembly 32.

The image fixing assembly 32 is provided at the rear of the transport belt assembly 56 and comprises heating and pressing rollers 58 and 60 arranged to form therebetween a nip aligned with the path of travel of a print sheet from the belt assembly 56. The print sheet passed from the transport belt assembly 56 is nipped between these heating and pressing rollers 58 and 60 so that the toner particles carried on the sheet are thermally fused and as a consequence the toner images are fixed on the sheet. In the event any failure takes place in the image fixing assembly 32, a code specifying the nature or location of the failure is indicated on the display window 20 of the control panel 16. Until a predetermined temperature is reached in the image fixing assembly 32 after the power supply switch 24 is depressed, an instruction to start a cycle of printing operation is not accepted if the print start key 20 is depressed before the predetermined temperature is reached in the assembly 32. The print sheet released from the rollers 58 and 60 is withdrawn to a paper collect tray 62 through a pair of paper discharge rollers 64 located posterior to the heating and pressing rollers 58 and 60.

Figure 3:
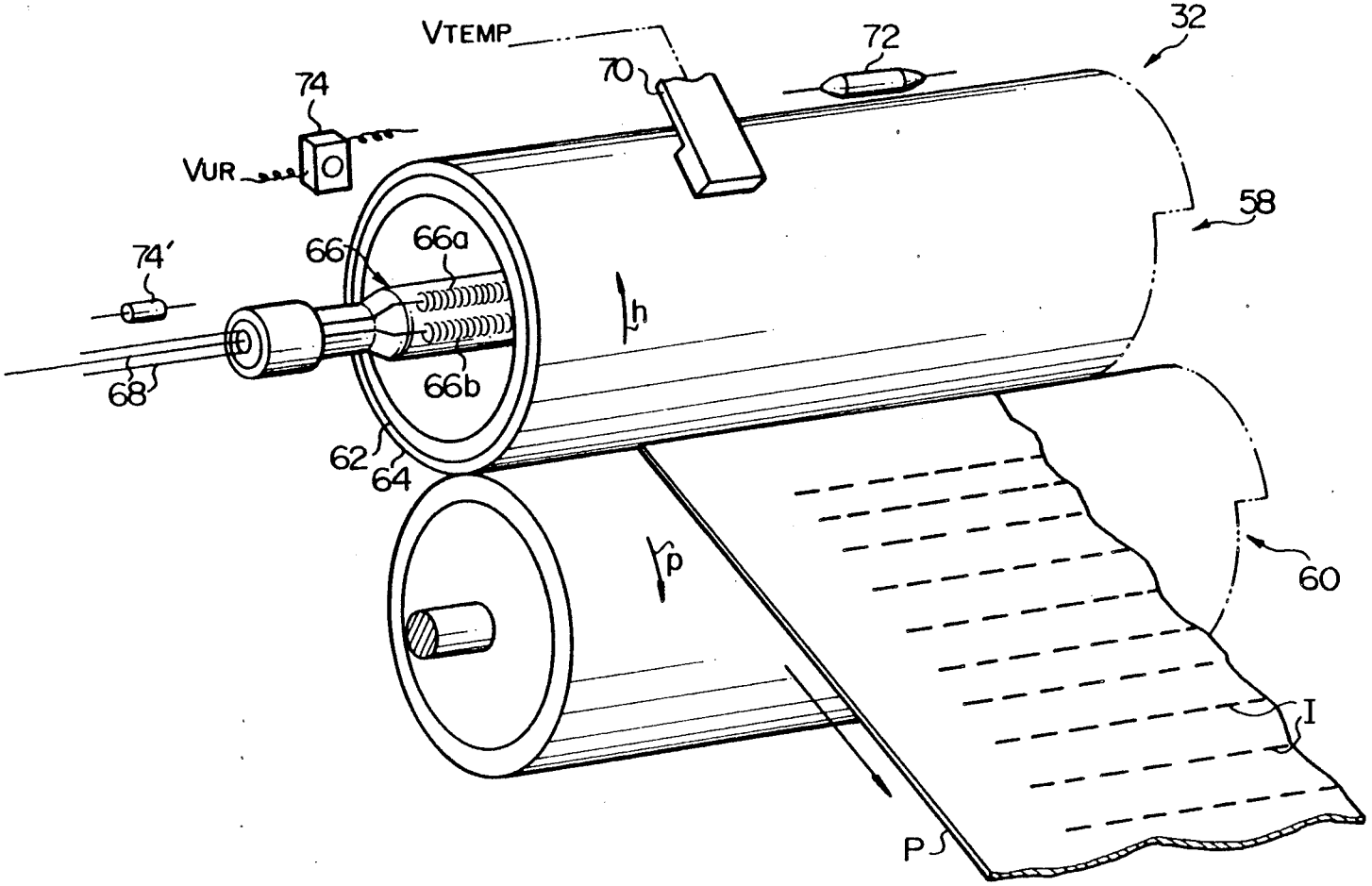
FIG. 3 is a fragmentary perspective view showing mechanical and electrical arrangements of the heater and pressing rollers which form part of an image fixing assembly incorporated in the image forming apparatus illustrated in FIGS. 1 and 2.

FIG. 3 shows the detailed arrangement of the heater and pressing rollers of the image fixing assembly 32. As shown, the heater roller 58 comprises a hollow cylindrical member 62 having a coating 64 of a smoothing material applied to the outer peripheral surface thereof. The coating 64 of the smoothing material is useful for precluding transfer of toner particles to the peripheral surface of the roller 58 from a print sheet P being passed between the rollers 58 and 60. Though not shown in the drawings, the heater roller 58 is rotatable about the center axis thereof and is supported on a shaft journalled in a suitable bracket member which forms part of the housing structure 10 of the apparatus. The pressing roller 60 is supported on a drive shaft (not shown) operatively connected to appropriate drive means which is assumed to include a drive motor $M_3$ and is to be driven for rotation about the center axis thereof and drives the heater roller 58 for rotation through the rolling engagement between the rollers 58 and 60.

Within the cylindrical member 62 of the heater roller 58 is provided a heater tube 66 which has fixedly enclosed therein main and auxiliary heater elements 66*a* and 66*b* each in the form of a wire filament. The main heater element 66*a* is adapted to be energized with an a.c. power of, for example, 900 watts while the auxiliary heater element 66*b* is adapted to be energized with an a.c. power of, for example, 400 watts. The auxiliary heater element 66*b* is to be energized additionally to the main heater element 66*a* to enable the heater roller 58 to be heated rapidly for some time after the apparatus is switched in with the power switch 24 turned on. The auxiliary heater element 66*b* may also be used to enable the heater roller 58 to be heated uniformly throughout its length. The main and auxiliary heater elements 66*a* and 66*b* in the heater tube 66 are connected in parallel across an a.c. power source through circuit lines 68.

In proximity to the outer peripheral surface of the heater roller 58 is located a roller temperature sensor 70 which is typically implemented by a thermister. The roller temperature sensor 70 is responsive to a change in the temperature of the heater roller 58 and produces an analog output signal $V_{TEMP}$ which is variable with the detected temperature of the outer peripheral surface of the roller 58. As will be described in more detail, the analog output signal $V_{TEMP}$ thus produced by the roller temperature sensor 70 implemented by a thermister is processed so that the rollers 58 and 60 are allowed to turn when it is confirmed that the heater roller 58 is heated to a working temperature higher than a predetermined level.

The circuit lines 68 leading from the parallel combination of the heater elements 66*a* and 66*b* in the heater tube 66 are connected to the a.c. power source through a temperature-sensitive circuit breaking element which is implemented by a fuse 72. The fuse 72 is responsive to the temperature of the heater roller 58 and is caused to blow and disconnects the heater elements 66*a* and 66*b* from the a.c. power source to prevent the roller 58 from being overheated when the temperature of the outer peripheral surface of the heater roller 58 rises beyond a predetermined value.

Within the heater roller 58 is further provided an ultrared ray sensor 74 which is fixedly located in conjunction with the heater tube 66 for being responsive to a condition in which the heater roller 58 or, more specifically, one or each of the heater elements 6*a* and 66*b* in the heater tube 66 is activated. The ultrared ray sensor 74 is herein assumed to be implemented by an ultrared-ray sensor sensitive to radiation of an ultrared ray from the heater roller 58 and operative to produce an analog output signal $V_{UR}$ variable with the ultrared ray radiation detected by the sensor 74. If desired, such an ultrared ray sensor 74 may be substituted by a magnetoresistance effect sensor 74' which is located in proximity to, for example, the circuit lines 68 connected to the heater elements 66*a* and 66*b* and which is sensitive to a change in the flow of current through the circuit lines 68.

During printing operation of the apparatus, a print sheet P bearing toner images I on one surface thereof is passed between the heater and pressing rollers 58 and 60 rotating in the opposite directions indicated by arrows h and p, respectively. The print sheet P being passed between the rollers 58 and 60 receives heat from the outer peripheral surface of the heater roller 58 so that the toner particles forming the images I on the print sheet P are fused and fixed on the surface of the sheet P.

Figure 4:
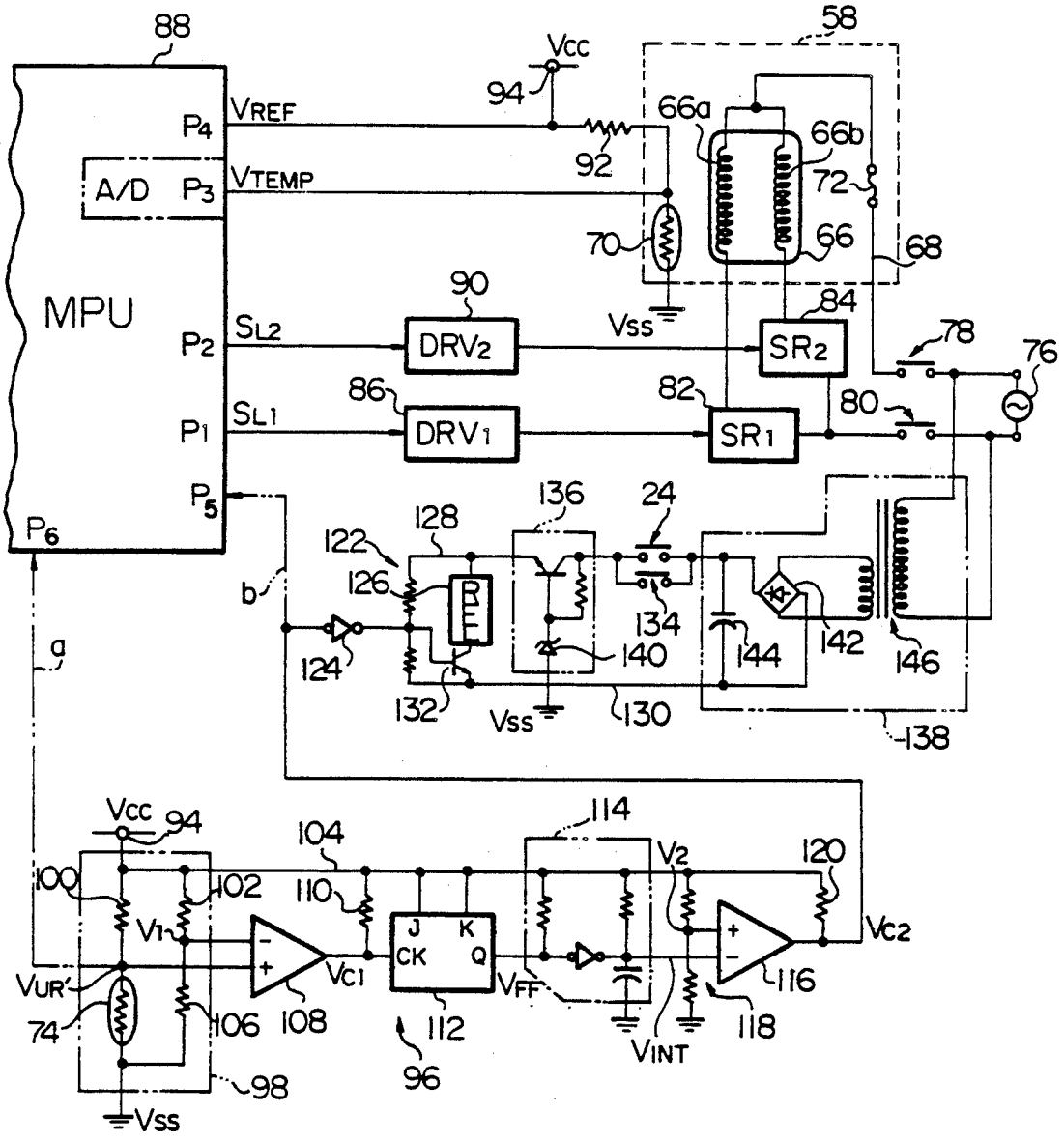
FIG. 4 is a diagram showing a control system for controlling the activation of the heater elements included in the heater roller which forms part of the image fixing assembly illustrated in FIG. 3.

The heater elements 66*a* and 66*b* of the heater tube 66 arranged within the heater roller 58 as hereinbefore described are activated under the control of a control system including the roller temperature sensor 70, fuse 72 and ultrared ray sensor 74 (or magnetoresistance sensor 74') as illustrated in FIG. 4.

As illustrated in FIG. 4, the heater elements 66*a* and 66*b* forming part of the heater tube 66 are electrically connected in parallel across an a.c. power source 76 through the lines 68 and fuse 72 and across a first contact set 78 of the normally open type. The a.c. power source 76 is typically implemented by a plug fitted to an ordinary convenience outlet. The main heater element 66*a* is connected to the a.c. power source 76 across a series combination cf a second contact set 80 of the normally open type and a first solid-state relay 82 ($SR_1$) and, likewise, the auxiliary heater element 66*b* is connected to the a.c. power source 76 across a series combination of the second contact set 80 and a second solid-state relay 84 ($SR_2$), as shown. The first solid-state relay 82 has a control terminal connected through a relay driver circuit 86 ($DRV_1$) to a first output port $P_1$ of a microprocessor unit 88 and, likewise, the second solid-state relay 84 has a control terminal connected through a relay driver circuit 90 ($DRV_2$) to a second output port $P_2$ of the microprocessor unit 88. The relay driver circuit 86 connected to the first solid-state relay 82 is responsive to a control signal $SL_1$ of logic "1" or "0" state from the microprocessor unit 88 to activate the relay 82 and enables the main heater element 66*a* to connect to the a.c. power source 76 through the relay 82 and across the first and second contact sets 78 and 80. Similarly, the relay driver circuit 90 connected to the second solid-state relay 84 is responsive to a control signal $S_{L2}$ of logic "1" or "0" state from the microprocessor unit 88 to activate the relay 84 and enables the auxiliary heater element 66*b* to connect to the a.c. power source 76 through the relay 84 and across the first and second contact sets 78 and 80. Each of the first and second solid-state relays 82 and 84 is typically provided in the form of a triac or bidirectional triode thyristor having a gate as the control terminal of the relay.

The roller temperature sensor 70 is connected at one end to ground ($V_{SS}$) and at the other to a source of a supply voltage $V_{CC}$ through a resistor 92 and further to a first input port $P_3$ of the microprocessor unit 88. The analog signal $V_{TEMP}$ variable with the temperature of the heater roller 58 as detected by the temperature sensor 70 is thus supplied to the first input port $P_3$ of the microprocessor unit 88. The supply voltage source 94 is also connected to a second input port $P_4$ of the microprocessor unit 88 to establish at the port $P_4$ a predetermined reference voltage $V_{REF}$ which is dictated by the supply voltage $V_{CC}$. The analog signal $V_{TEMP}$ supplied to the first input port $P_3$ of the microprocessor unit 88 is converted into a corresponding digital signal on the basis of the reference voltage $V_{REF}$ by means of an analog-to-digital converter incorporated in the microprocessor unit 88. The digital signal thus produced by the analog-to-digital converter is compared with reference temperature data memorized in the microprocessor unit 88. These reference temperature data are indicative of predetermined upper and lower limit temperatures of the outer peripheral surface of the heater roller 58.

Insofar as the control system for the heater tube 66 is normally operative, the first and second contact sets 78 and 80 connected to the a.c. power source 76 are maintained closed so that the heater elements 66*a* and 66*b* of the heater tube 66 are energized or de-energized depending simply on the status of the respectively associated first and second solid-state relays 82 and 84.

In the image forming apparatus embodying the present invention, an automatic diagnostic operation is performed immediately after the power supply switch 24 (FIG. 1) is turned on to see if the heater tube 66 of the image fixing assembly 32 is unduly activated with any failure present in the control system. Alternatively, the automatic diagnostic operation of the apparatus embodying the present invention may be performed during any time intervals intervening between any cycle of copying operation. For this purpose, pulses of alternately logic "1" and "0" states are supplied successively from the first output port $P_1$ of the microprocessor unit 88 for a certain period of time after the power supply switch 24 is turned on. If the control system is properly operative, the main heater element 66*a* of the heater tube 66 must be activated and de-activated alternately in response to these pulses of alternately logic "1" and "0" states. By reason of the thermal capacity which the heater roller 58 has or in the event any failure i present in the control system, the temperature sensor 70 implemented by a thermister provided in conjunction with the heater roller 58 could not respond to the recurrent turn-on and turn-off states of the heater tube 66.

In the control system of the apparatus embodying the present invention, the recurrent turn-on and turn-off states of the heater tube 66 are thus detected not from the signal $V_{TEMP}$ from the roller temperature sensor 70 but on the basis of the analog output signal $V_{UR}$ variable with the ultrared ray radiation detected by the ultrared ray sensor 74.

In the control system shown in FIG. 4 is thus further provided a digital malfunction detector network 96 which comprises a resistor bridge circuit 98 composed of a pair of resistors 100 and 102 commonly connected through a bus line 104 to the source 94 of the supply voltage $V_{CC}$ and a pair of resistors which consist of a resistor 106 and a variable resistor implemented by the ultrared ray sensor 74. The resistor 106 and ultrared ray sensor 74 are commonly connected to ground ($V_{SS}$) and are serially connected to the resistors 100 and 102, respectively, to provide a first output node between the resistor 100 and ultrared ray sensor 74 and a second output node between the resistors 102 and 106. By preference, the ultrared ray sensor 74 may be connected to a third input port $P_6$ of the microprocessor unit 88 as indicated by a phantom line a.

The digital malfunction detector network 96 further comprises a first comparator circuit 108 having a non-inverting input terminal connected to the first output node of the resistor bridge circuit 98 and an inverting input terminal connected to the second output node of the bridge circuit 98. The comparator circuit 108 further has an output terminal pulled up to the bus line 104 through a pull-up resistor 110 and connected to the clock terminal CK of a clocked J-K flipflop circuit 112. The clocked J-K flipflop circuit 112 has J and K input terminals connected to the bus line 104 and a non-inverted output terminal Q connected to an integrator circuit 114. The integrator circuit 114 is shown an output terminal connecting an inverting input terminal of a second comparator circuit 116 which has a non-inverting input terminal connected to the bus line 104 through a voltage divider circuit 118. The second comparator circuit 116 has an output terminal pulled up to the bus line 104 through a pull-up resistor 120.

The output terminal of the second comparator circuit 116 is connected to a switch control network 122 which controls the switching actions of the normally open first and second contact sets 78 and 80. The switch control network 122 comprises an amplifier 124 having an input terminal connected to the output terminal of the second comparator circuit 116 and an output terminal connected to a relay unit 126. The relay unit 126 has an excitation coil connected between positive and negative bus lines 128 and 130 through the current path of a switching transistor 132 having a base connected to the output terminal of the amplifier 124. The relay unit 126 is associated with the first and second contact sets 78 and 80 and further with a normally open third contact set 134 connected in shunt across with the power supply switch 24. The parallel combination of the power supply switch 24 and the third contact set 134 associated with the relay unit 126 is inserted in the positive bus line 128 and intervenes between a constant current circuit 136 and a full-wave rectifier circuit 138. As shown, the constant current circuit 136 may be of the type using a constant voltage element implemented by a Zener diode 140 and the full-wave rectifier circuit 138 may be of the type using a diode bridge circuit 142 and a smoothing capacitor 144. The full-wave rectifier circuit 138 further has a transformer 146 having a primary winding connected across the a.c. power source 76 and a secondary winding connected across the diode bridge circuit 142. By preference, the output terminal of the second comparator circuit 116 may be connected to a fourth input port $P_5$ of the microprocessor unit 88 as indicated by a phantom line b.

Figure 5:
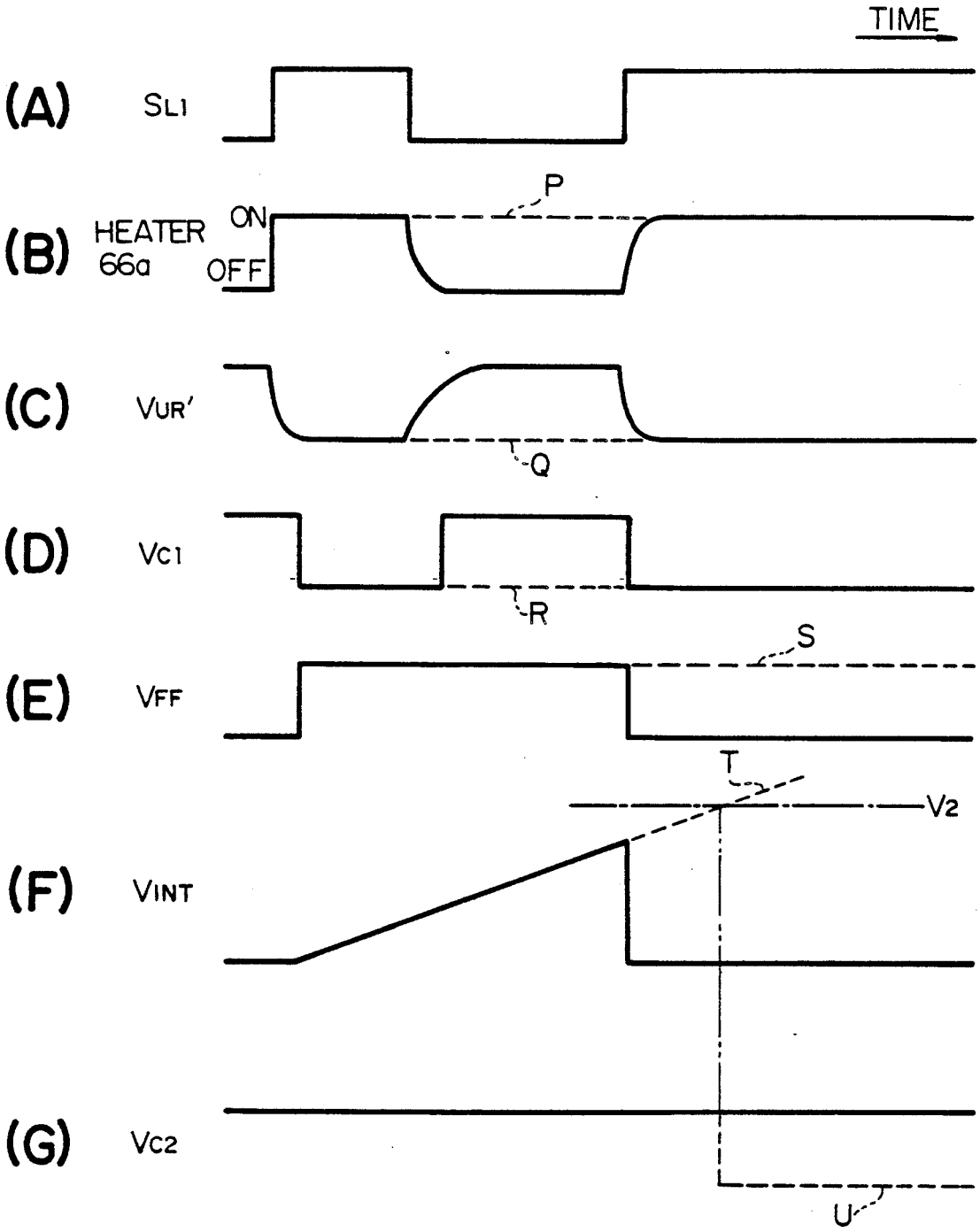
FIG. 5 is a timechart showing various waveforms which may be produced in the control system illustrated in FIG. 4.

The basic mode of operation of the control system thus constructed and arranged will now be described with reference to FIGS. 4 and 5.

When the power supply switch 24 of the apparatus is manually turned on by the operator, the switching transistor 132 of the switch control network 122 receives at its base a voltage normally higher than the threshold voltage of the transistor 132 with a voltage of logic "1" state supplied through the associated amplifier 124 The transistor 132 being thus turned on, the relay unit 126 of the switch control system 122 is energized from the a.c. power source 76 also through the full-wave rectifier circuit 138, power supply switch 24 and constant current circuit 136. The normally open third contact set 134 associated with the relay unit 126 is caused to close to form a self-holding current path between the relay unit 126 and the full-wave rectifier circuit 138. With the relay unit 126 energized, not only the third contact set 134 but also each of the normally open first and second contact sets 78 and 80 is caused to close. The main and auxiliary heater elements 66*a* and 66*b* of the heater tube 66 are now connected to the a.c. power source 76 through the first contact set 78 and each of the first and second solid-state relays 82 and 84 is connected to the a.c. power source 76 through the second contact set 80.

When a stable state is established in the microprocessor unit 88 in a certain period of time after the power supply switch 24 is closed, control signals $S_{L1}$ and $S_{L2}$ each of logic "1" state are output from the first and second output ports $P_1$ and $P_2$ of the microprocessor unit 88. These control signals $S_{L1}$ and $S_{L2}$ are supplied through the driver circuits 86 and 90 to the control terminals of the first and second solid-state relays 82 and 84, respectively. Accordingly, the first and second solid-state relays 82 and 84 are activated to connect the heater elements 66*a* and 66*b* across the a.c. power source 76 through the first and second contact sets 78 and 80 and respectively through the first and second solid-state relays 82 and 84. Each of the main and auxiliary heater elements 66*a* and 66*b* of the heater tube 66 is now energized from the a.c. power source 76 to heat the heater roller 58.

With the heater roller 58 thus heated by the heater elements 66*a* and 66*b*, the roller temperature sensor 70 implemented by a thermister detects the temperature rise of the roller 58 and supplies to the first input port $P_3$ of the microprocessor unit 88 an analog signal $V_{TEMP}$ representing the detected temperature of the heater roller 58. The analog signal $V_{TEMP}$ supplied to the first input port $P_3$ of the microprocessor unit 88 is converted into a corresponding digital signal on the basis of the reference voltage $V_{REF}$ established at the second input port $P_4$ of the microprocessor unit 88. The digital signal thus produced is compared with the predetermined upper and lower limit temperatures of the outer peripheral surface of the heater roller 58 as memorized in the microprocessor unit 88 When the temperature represented by the analog output signal $V_{TEMP}$ from the roller temperature sensor 70 is found to be higher than the upper limit temperature, the microprocessor unit 88 outputs signals $S_{L1}$ and $S_{L2}$ each of logic "0" state from the first and second output ports $P_1$ and $P_2$, respectively, thereof. In response to these signals $S_{L1}$ and $S_{L2}$ each of the logic "0" state, the first and second relay driver circuits 86 and 90 de-activate the first and second solid-state relays 82 and 84, respectively, so that each of the main and auxiliary heater elements 66a and 66b of the heater tube 66 is disconnected from the a.c. power source 76 and is accordingly de-energized. When, conversely, the temperature represented by the analog output signal $V_{TEMP}$ from the roller temperature sensor 70 is found to be lower than the lower limit temperature represented by the second reference temperature signal, the microprocessor unit 88 outputs a signal $S_{L1}$ of logic "1" state from the first output port $P_1$ thereof. In response to this signal $S_{L1}$ of the logic "1" state, the first relay driver circuit 86 activates the first solid-state relay 82 so that the main heater element 66a of the heater tube 66 is connected to the a.c. power source 76 and is accordingly energized with the auxiliary heater element 66b maintained disconnected from the a.c. power source 76.

The first and second contact sets 78 and 80 associated with the relay unit 126 are maintained closed and accordingly the heater elements 66a and 66b of the heater tube 66 are energized or de-energized under the control of the signals $S_{L1}$ and $S_{L2}$ from the first and second output ports $P_1$ and $P_2$ of the microprocessor unit 88 as far as the control system for the heater tube 66 is normally operative. In response, for example, of the transition of the signal $S_{L1}$ from the logic "0" to logic "1" state or from the logic "1" to logic "0" state as shown in waveform (A) of FIG. 5, the main heater element 66a of the heater tube 66 will be activated to turned on or de-activated to turned off, respectively, as indicated by waveform (B) of FIG. 5 The turn-on or turn-off state of the heater roller 58 is detected on the basis of the analog output signal $V_{UR}$ from the ultrared ray sensor 74 which is responsive to the ultrared ray radiation generated from the heater tube 66. A signal voltage $V_{UR}'$ variable with the analog output signal $V_{UR}$ from the ultrared ray sensor 74 as indicated by waveform (C) of FIG. 5 is produced at the first output node of the resistor bridge circuit 98. As will be seen from comparison between the waveforms (A) and (C) the signal voltage $V_{UR}'$ supplied from the bridge circuit 98 has logic "1" and "0" states largely responsive to the logic "0" and "1" states, respectively, of the signal $S_{L1}$ from the first output port $P_1$ of the microprocessor unit 88. The rise-times and falltimes of the signals $S_{L1}$ and $S_{L2}$ are selected in consideration of the response characteristics of the ultrared ray sensor 74.

The signal voltage $V_{UR}'$ thus produced by the resistor bridge circuit 98 is supplied to the non-inverting input terminal of the first comparator circuit 108. In the first comparator circuit 108, the signal voltage $V_{UR}'$ supplied from the first output node of the bridge circuit 98 is compared with a fixed reference voltage $V_1$ produced at the second output node of the bridge circuit 98. The first comparator circuit 108 will thus produce an output signal $V_{C1}$ varying as indicated by waveform (D) of FIG. 5 in response to the analog output signal $V_{UR}$ from the ultrared ray sensor 74. Such a signal $V_{C1}$ from the first comparator circuit 108 is latched in the clocked J-K flipflop circuit 112. A signal $V_{FF}$ indicated by waveform (E) in FIG. 5 is thus output from the clocked J-K flipflop circuit 112 and is integrated with respect to time by means of the integrator circuit 114 which thus produces a saw-tooth wave signal voltage $V_{INT}$ indicated by waveform (F) in FIG. 5.

The signal voltage $V_{INT}$ output from the integrator circuit 114 is supplied to the inverting input terminal of the second comparator circuit 116 and is compared with a fixed reference voltage $V_2$ produced at the node between the resistors forming the voltage divider circuit 118. The resistors of the voltage divider circuit 118 are selected so that the reference voltage $V_2$ is higher than the maximum value of the output signal voltage $V_{INT}$ from the integrator circuit 114 insofar as the signal $V_{FF}$ output from the clocked J-K flipflop circuit 112 is in the form of pulses of alternately logic "1" and "0" states. With the signal $V_{FF}$ alternately shifting between the logic "0" and "1" states, the signal voltage $V_{INT}$ from the integrator circuit 114 is thus lower than the fixed reference voltage $V_2$ so that the second comparator circuit 116 produces a logic "1" output signal $V_{C2}$ as indicated by waveform (G) in FIG. 5. The signal $V_{C2}$ of the logic "1" state is supplied through the amplifier 124 to the switch control network 122 and maintains the transistor 132 in the conduction state and accordingly the relay unit 126 in the excited condition.

The relay unit 126 being thus maintained operative the main heater element 66a of the heater tube 66 is activated and de-activated alternately under the control of the signal $S_{L1}$ from the microprocessor unit 88 so that the heater roller 58 is heated to a temperature within a fixed range defined between the predetermined upper and lower limit temperatures memorized in the microprocessor unit 88, as far as the control system for the heater tube 66 is normally operative.

It may then happen that the heater tube 66 is activated despite each of the signals $S_{L1}$ and $S_{L2}$ from the microprocessor unit 88 swung to the logic "0" state, as indicated by broken line P in respect of the waveform (B). When this occurs, the first comparator circuit 108 receives a signal voltage $V_{UR}'$ of logic "0" level from the bridge circuit 98 and outputs a signal $V_{C1}$ of also logic "0" state to the clocked J-K flipflop circuit 112, as indicated by broken lines Q and R in respect of the waveforms (C) and (D) Under these conditions , the output signal $V_{FF}$ from the clocked J-K flipflop circuit 112 is maintained at the logic "1" state as indicated by broken line S in respect of the waveform (E) with the result that the signal voltage $V_{INT}$ output from the integrator circuit 114 and supplied to the second comparator circuit 116 will increase beyond the predetermined reference voltage $V_2$, as indicated by broken line T in respect of the waveform (F). At the point of time the signal voltage $V_{INT}$ is increased to the level of the reference voltage $V_2$, the output signal $V_{C2}$ from the second comparator circuit 116 shifts to a logic "0" state as indicated by broken line U in respect of the waveform (G) shown in FIG. 5. The signal $V_{C2}$ of the logic "0" state is supplied through the amplifier 124 to the switch control network 122 and causes the switching transistor 132 to turn off with the base voltage of the transistor 132 reduced below the threshold value thereof. The transistor 132 being thus turned off, the relay unit 126 is de-activated so that each of the first, second and third contact sets 78, 80 and 134 is caused to open. The first and second contact sets 78 and 80 being made open, the main and auxiliary heater elements 66*a* and 66*b* of the heater tube 66 are disconnected from the a.c. power source 76 and are thus forcibly de-energized. Where the first output node of the resistor bridge circuit 98 is connected to the third input port $P_5$ of the microprocessor unit through the line b, the signal $V_{C2}$ of the logic "0" state may be passed to the microprocessor unit 88 through the port $P_5$ and used to produce a coded display signal to be indicated on the display window 20 of the control panel 16 (FIG. 1) to inform the operator of the unusual activation of the heater tube 66.

As will have been understood from the foregoing description, the control system of the apparatus thus far described is characterized inter alia in that whether or not the heater tube 66 is unusually activated is determined not from the signal $V_{TEMP}$ output from the roller temperature sensor 70 but on the basis of the signal $V_{UR}$ output from the ultrared ray sensor 74. This means that the state of the heater tube 66 is inspected without respect to the temperature to which the heater roller 58 is heated after the apparatus is switched in. When any failure is present in the control system so that the heater tube 66 is unusually activated after the apparatus is switched in, the heater tube 66 is thus automatically deactivated upon detection of such unusual activation of the heater tube 66. The heater tube 66 could not therefore be activated unless the failure in the control system is remedied and, if the power supply switch 24 is turned on repeatedly with the failure unremedied, any accident which might otherwise result from improper activation of the heater tube 66 such as the damage of the heater roller 58 or the firing from the roller 58 as might be caused due to an overheat of the heater roller in a prior-art image forming apparatus can be reliably precluded in the apparatus embodying the present invention.

The control system of the apparatus embodying the present invention is further characterized in that the means operative to prevent the heater tube 66 from undue activation is implemented not by any software program incorporated into the microprocessor unit 88 but by the hardware configuration which is largely composed of the digital malfunction detector network 96 and switch control network 122. This is beneficial for conquering official approvals under various local industrial regulations and standards such as the CSA and TUF standards for the safety of operation of the image fixing assembly of an apparatus according to the present invention. Where the restrictions under such industrial regulations and standards are not important considerations, the signal voltage $V_{UR}$ output from the ultrared ray sensor 74 may be passed to the microprocessor unit 88 through the line a and the fourth input port $P_6$ of the microprocessor unit 88 and processed in accordance with an appropriate software program incorporated into the microprocessor unit 88 to achieve results similar to those obtained by the hardware configuration composed of the networks 96 and 122.

In the meantime, it may happen that the relay unit 126 of the switch control network 122 is de-energized although the heater tube 66 and each of the first and second solid-state relays 82 and 84 are properly operative. This takes place when the signal $S_{L1}$ output from the first output port $P_1$ or the signal $S_{L2}$ output from the second output port $P_2$ of the microprocessor unit 88 is fixed at logic "1" level with any failure invited in the microprocessor unit 88. Such a failure in the microprocessor unit 88 may be caused due to a noise allowed into the microprocessor unit 88 to damage caused to the software program stored therein or due to a malfunction of the software program An accident of this nature can also be detected on the basis of the signal $V_{UR}$ produced by the ultrared ray sensor 74 so that the failure invited in the microprocessor unit 88 or the malfunction of the program incorporated in the microprocessor unit 88 could not result in improper operation of the heater tube 66.

If, desired, furthermore, the data produced on the basis of the signal $V_{TEMP}$ supplied to the first input port $P_3$ and the data produced on the basis of the signal $V_{UR}$ or signal $V_{C2}$ supplied to the third or fourth input port $P_6$ or $P_5$ of the microprocessor unit 88 may be heuristically monitored in relation to the the data to result in the signal $S_{L1}$ or signal $S_{L2}$ to be supplied from the first or second output port $P_1$ or $P_2$ of the microprocessor unit 88. The result of such monitoring may be used for the detection of the failure or malfunction of any of the individual component elements of the control system for the heater tube 66. Such a failure or malfunction of any component element of the control system may be the breaking or any other defect of the main or auxiliary heater element 66*a* or 66*b* of the heater tube 66, a failure or malfunction of the temperature sensor 70 implemented by a thermister, a short circuit caused across the solid-state relay 82 or 84, or inability of the relay 82 or 84 to close.

It may be further noted that the control system of the apparatus embodying the present invention is capable of discriminating between a failure or malfunction of the heater element 66*a* or 66*b* of the heater tube 66 and a failure or malfunction of the temperature sensor 70. Suppose now that it is confirmed immediately after the apparatus is switched in that each of the main and auxiliary heater elements 66*a* and 66*b* of the heater tube 66 is properly operative with the signal voltage $V_{C2}$ of logic "1" state established at the output terminal of the second comparator circuit 116. If, under this condition, there is no significant information afforded by the signal voltage $V_{TEMP}$ supplied from the temperature sensor 70 to the first input port $P_3$ of the microprocessor unit 88, then the microprocessor unit 88 may determine that the temperature sensor 70 is defective. Detecting the defective temperature sensor in this fashion will significantly reduce the amounts of time and labor necessitated for the trouble-shooting of the apparatus in view of the fact that a failure of the heater tube may be erroneously taken for the failure of the associated temperature sensor in a prior-art apparatus.

Figure 6:
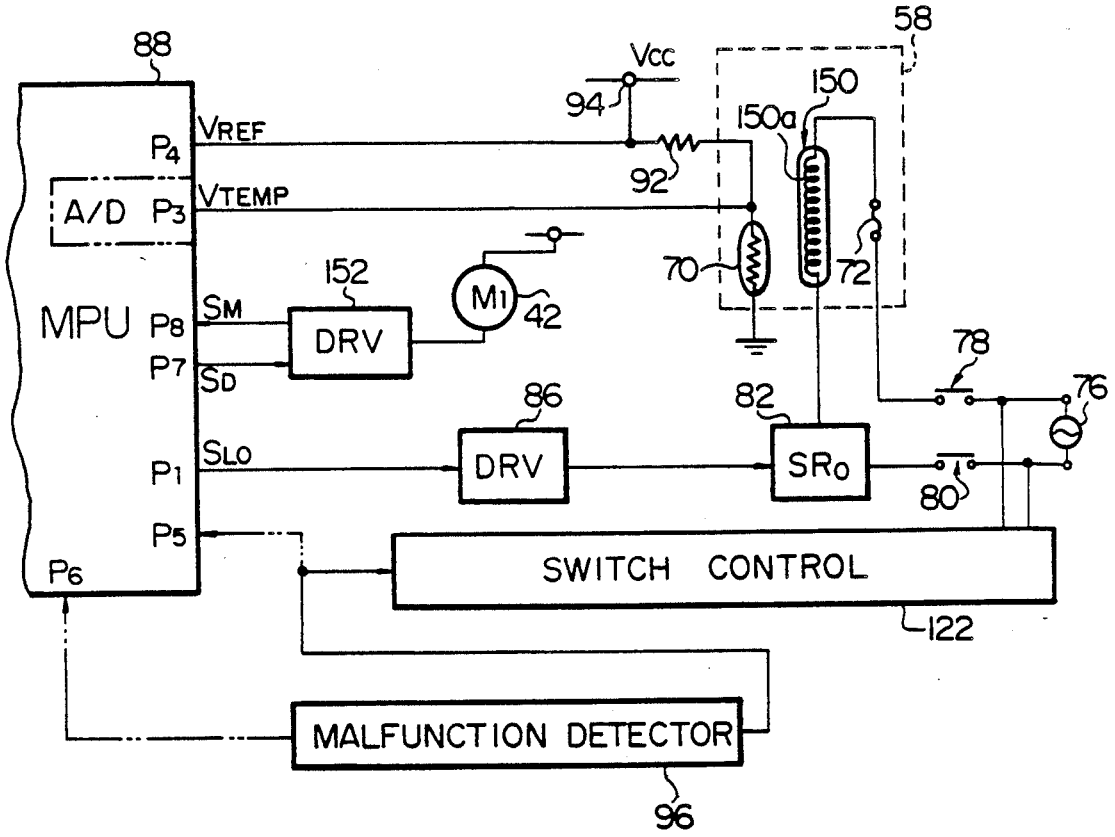
FIG. 6 is a diagram showing part of a control system for controlling the activation of the heater element included in a single-element heater tube which may be alternatively used in the image fixing assembly illustrated in FIG. 3.

While it has been assumed that the heater roller of the image fixing assembly 32 of the apparatus embodying the present invention uses a heater tube having two, main and auxiliary heater elements, the gist of the present invention is applicable to an image forming apparatus having an image fixing assembly of the type using a heater tube having a single heater element. FIG. 6 shows part of the circuit arrangement of a control for such a single-element heater tube 150.

As illustrated in FIG. 6, the heater tube 150 has fixedly enclosed therein a single heater element 150*a* in the form of a wire filament electrically connected across an a.c. power source 76 through lines 68 and a fuse 72 and across a first contact set 78 of the normally open type The heater element 150*a* is connected to the a.c. power source 76 across a series combination of a second contact set 80 of the normally open type and a solid-state relay 82 ($SR_0$), as shown. The solid-state relay 82 has a control terminal connected through a relay driver circuit 86 to the first output port $P_1$ of the microprocessor unit 88. The relay driver circuit 86 connected to the first solid-state relay 82 is responsive to a control signal $S_{L0}$ of logic "1" or "0" state from the microprocessor unit 88 to activate the relay 82 and enables the heater element 150*a* to connect to the a.c. power source 76 through the relay 82 and across the first and second contact sets 78 and 80. Thus, the arrangement including the heater element 150*a*, fuse 72, a.c. power source 76, contact sets 78 and 80, relay driver circuit 86 is similar to the arrangement including the main heater element 66*a*, fuse 72, a.c. power source 76, contact sets 78 and 80, first relay driver circuit 86 and operates similarly to the latter in respect of the main heater element 66*a* thereof.

In the control system shown in FIG. 6 is further provided a driver circuit 152 connected to the main drive motor 42 for the optical scanning system 26 and image transfer drum 40. This driver circuit 152 receives from an output port $P_7$ of the microprocessor unit 88 a signal $S_D$ effective to actuate the main drive motor 42 into operation. When the main drive motor 42 is thus actuated into operation, the driver circuit 152 produces a signal $S_M$ of, for example, a logic "1" state indicating that the main drive motor 42 in operation. Such a signal $S_M$ is supplied to an input port $P_7$ of the microprocessor unit 88 to inform the microprocessor unit 88 that the apparatus is currently in operation.

The present invention has been described as being applied to the image fixing assembly of an image forming apparatus such as an electrophotographic image duplicating or printing apparatus. Where the present invention is to be applied specifically to an electrophotographic image duplicating apparatus, the control system which has been described in detail may be used not only for the control of the heater tube of the image fixing assembly but for coping with improper activation of the document exposure lamp forming part of the optical scanning system of the apparatus.

What is claimed is:

1. An image forming apparatus including a radiation emitting element having an operative condition emitting radiation and an inoperative condition not emitting radiation, comprising (a) a power supply circuit for electrically energizing said radiation emitting element through switch means, (b) a digital control network for producing a control signal effective to actuate said switch means to cyclically close and open for the purpose of inspecting said radiation emitting element for any malfunction, (c) a detecting element directly responsive to the operative and inoperative conditions of said radiation emitting element, the detecting element being operative to produce a signal indicating the detected condition of the radiation emitting element, (d) malfunction detecting means for producing a malfunction signal indicating a malfunction of said radiation emitting element on the basis of the signal from said detecting element in the presence of the control signal from said digital control network, the malfunction detecting means being operative to produce the malfunction signal when the signal from said detecting element indicates that said radiation emitting element is in a condition continuously emitting radiation, and (e) means for forcibly disabling said power supply circuit in response to the malfunction signal from said malfunction detecting means.

2. An image forming apparatus as set forth in claim 1, in which said radiation emitting element consists of a heater element included in a toner image fixing assembly which forms part of the image forming apparatus.

3. An image forming apparatus as set forth in claim 1, in which said digital control network is operative to produce said control signal for a predetermined period of time after the image forming apparatus is switched in.

4. An image forming apparatus as set forth in claim 3, in which said radiation emitting element is one of a plurality of radiation emitting elements which are to successively receive said control signal from said digital control network.

5. An electrophotographic image duplicating apparatus comprising (a) means for electrophotographically producing a toner image on a recording sheet medium, (b) a toner image fixing assembly comprising a heater unit having an operative condition to thermally fix said toner image on said recording sheet medium, (c) a power supply circuit for electrically energizing said heater unit through switch means, (d) a microprocessor unit for controlling said power supply circuit, the microprocessor unit being operative to supply to said power supply circuit a control signal effective to actuate said switch means to cyclically close and open for a predetermined period of time for the purpose of inspecting said heater unit for any malfunction, (e) a detecting element directly responsive to the condition of said heater unit and operative to produce a signal indicative of the detected condition of the heater unit, (f) a malfunction detector network responsive to the signal from said detecting element, the malfunction detector network being operative to produce a malfunction signal indicating a malfunction of said heater unit when, in the presence of the control signal from said microprocessor unit, the signal from said detecting element indicates that said heater unit is continuously in operation, and (g) disabling means for forcibly disabling said power supply circuit in response to the malfunction signal from said malfunction detector network.

6. An electrophotographic image duplicating apparatus as set forth in claim 5, in which malfunction detector network comprises an integrator circuit and a comparator for comparing an output signal from the integrator circuit with a predetermined voltage signal, said integrator circuit being operative to integrate a voltage variable with the signal from said detecting element.

7. An electrophotographic image duplicating apparatus as set forth in claim 5, in which said disabling means comprises a contact set intervening between a power source and said power supply circuit, and a relay unit operative to cause said contact set to open or close in response to the malfunction signal from said malfunction detector network.

8. An electrophotographic image duplicating apparatus as set forth in claim 5, further comprising a temperature sensitive element disposed in proximity to said heater unit and operative to produce a signal variable with the temperature of the heater unit, the signal from the temperature sensitive element being supplied to said microprocessor unit which then determines that the temperature sensitive element is improperly operative if the signal from the temperature sensitive element is indicative of no variation of temperature of said heater unit in the absence of said malfunction signal from said malfunction detector network.

* * * * *